US005963762A

United States Patent [19]

Furuya et al.

[11] Patent Number: 5,963,762

[45] Date of Patent: Oct. 5, 1999

[54] ELECTROPHOTOGRAPHIC APPARATUS PERFORMING IMAGE EXPOSURE AND DEVELOPMENT SIMULTANEOUSLY

[75] Inventors: Tadashi Furuya; Junji Araya; Hideyuki Yano, all of Yokohama; Harumi Kugo, Kawasaki; Osamu Iwasaki, Yokohama, all of Japan

[73] Assignee: Canon Kabushiki Kaisha, Tokyo, Japan

[21] Appl. No.: 08/975,445

[22] Filed: Nov. 21, 1997

Related U.S. Application Data

[63] Continuation of application No. 08/598,139, Feb. 7, 1996, abandoned, which is a continuation of application No. 08/171,708, Dec. 22, 1993, abandoned.

[30] Foreign Application Priority Data

Dec. 26, 1992 [JP] Japan ..... 4-359311

[51] Int. Cl.[6] ..... G03G 15/02

[52] U.S. Cl. ..... 399/174; 399/159

[58] Field of Search ..... 399/50, 53, 130, 399/159, 168, 174, 175, 267, 265; 347/111, 112, 129; 430/127, 133, 134

[56] References Cited

U.S. PATENT DOCUMENTS

| | | | |
|---|---|---|---|
| 3,850,631 | 11/1974 | Tamai | 430/134 |
| 4,588,990 | 5/1986 | Tamura | 346/160 X |
| 4,637,973 | 1/1987 | Shigeta et al. | 430/122 |
| 4,693,951 | 9/1987 | Takasu et al. | 346/153.1 X |
| 4,717,999 | 1/1988 | Kaneko | 346/160 |
| 4,757,332 | 7/1988 | Yuasa | 346/160 |
| 4,844,008 | 7/1989 | Sakemi et al. | 355/253 X |
| 4,851,926 | 7/1989 | Ishikawa | 346/160 X |
| 4,983,481 | 1/1991 | Yu | 430/59 |
| 5,053,821 | 10/1991 | Kunugi et al. | 355/245 |
| 5,138,387 | 8/1992 | Sato et al. | 355/251 |
| 5,144,368 | 9/1992 | Ohzeki et al. | 355/219 |
| 5,159,389 | 10/1992 | Minami et al. | 355/211 |
| 5,172,163 | 12/1992 | Yamaoki et al. | 355/210 |
| 5,202,729 | 4/1993 | Miyamoto et al. | 355/251 |
| 5,284,731 | 2/1994 | Tyagi et al. | 430/126 |
| 5,291,246 | 3/1994 | Tsukamoto | 355/210 |
| 5,298,945 | 3/1994 | Wada et al. | 355/210 |

FOREIGN PATENT DOCUMENTS

| | | |
|---|---|---|
| 52-117134 | 10/1977 | Japan . |
| 54-161942 | 12/1979 | Japan . |
| 58-153957 | 9/1983 | Japan . |
| 62-209470 | 9/1987 | Japan . |
| 63-91667 | 4/1988 | Japan . |
| 2180948 | 4/1987 | United Kingdom . |

*Primary Examiner*—Sandra Brase

*Attorney, Agent, or Firm*—Fitzpatrick, Cella, Harper & Scinto

[57] ABSTRACT

An electrophotographic apparatus which simultaneously performs image exposure and development, including an electrophotographic photosensitive body having a conductive layer, an electrophotoconductive layer, and an electric charge supply layer for contacting a developer sequentially formed on a translucent substrate, wherein a value of the surface energy of the outer layer of the photosensitive body is 30 dyne/cm or less in order to present fogging generated during development.

14 Claims, 4 Drawing Sheets

ELECTROPHOTOGRAPHIC APPARATUS PERFORMING IMAGE EXPOSURE AND DEVELOPMENT SIMULTANEOUSLY

This application is a continuation of application Ser. No. 08/598,139, filed Feb. 7. 1996, now abandoned, which is a continuation of application Ser. No. 08/171,708, filed Dec. 22, 1993, now abandoned.

BACKGROUND OF THE INVENTION

1. Field of the Invention

The present invention relates to an image forming apparatus and electrophotographic method for forming an electrostatic latent image on an optical body and developing the electrostatic latent image with toner. More specifically, the present invention relates to an image forming apparatus and back exposure method for exposing the back surface of the photosensitive body to light.

2. Related Background Art

As means for obtaining a hard copy, such as a copying machine, a computer, and so on, image forming apparatus utilizing the electrophotographic method have been widely used. A typical image forming apparatus has a photosensitive body and devices for image formation arranged around the photosensitive body. More specifically, around the photosensitive body, there are provided a charger device, an exposure device, a developer device, a transfer device, a cleaning device, and so on. This-image forming apparatus and electrophotographic method carriers out an image forming process comprising steps of charging the photosensitive body with electricity, exposing the photosensitive body to light in order to form an electrostatic latent image on the photosensitive body, developing the resultant electrostatic latent image by applying toner to it to obtain a toner image, transferring the developed toner image onto a transfer medium, and subsequently fixing the transferred toner image on the transfer medium to finally obtain a print image.

Compared with print images obtained from other means for obtaining hard copies, such as those of thermal transfer type, of ink jet type, of impact printing type, or the like, the print image obtained as described above has higher resolution and stronger contrast, that is, as a whole, high quality.

However, as described before, the image forming process by the electrophotographic method requires many devices. So, the apparatus therefor tends to be of a large size and complicated. It is not easy to miniaturize and simplify the apparatus.

In order to solve this problem, some methods have been proposed in which, while using the same electrophotographic method, the apparatus carries out all the processes such as electrification, exposure development, and so on substantially at the same time and at the same position (such combined processes will be referred to "simplified process"). Among such methods, typical ones are disclosed, for example, in Japanese Laid-Open Patent Appln. Nos. 58-153957, 62-209470 and so on. In general, in these methods, either conductive toner or conductive carriers, and insulating toner are used, and the image forming process comprises steps of (1) cleaning the residual toner which was not transferred during the previous image forming process; (2) contact electrification; (3) image exposure from the back surface of the photosensitive body; and (4) contact development. The series of steps are performed in a developing nip between the photosensitive body and a magnetic brush roller which corresponds to an exposure position on the back surface of the photosensitive body and which is in contact with the outer surface of the photosensitive body.

More specifically, as shown in FIG. 2, a magnetic brush provided upstream in the developing nip N between a developer sleeve 22 and a photosensitive body 1 scrapes the residual toner which was not transferred (hereinafter referred to as "transfer residual toner") to clean the photosensitive body 1. As the toner employed here is magnetic toner T and a fixed magnet 23 is arranged inside the developer sleeve 22, magnetic force can improve the cleaning effect.

Then, the surface of the photosensitive body 1 is brushed by a conductive magnetic brush (of conductive toner or conductive carriers) to apply electric charge to the surface of the photosensitive body 1. As the electrification is carried out by trapping electric charge in impurity levels on the surface of the photosensitive body 1, charger member(s) having very small resistance and a long period of electrification are required to carry out electrification sufficiently. Therefore, material which sufficiently holds electricity near its surface is needed. As such a material, amorphous silicon (hereinafter referred to as "a-Si"), selenium, and so on are preferably used.

The above-mentioned cleaning operation and electrification are performed at the same time in a cleaning-electrification region Nc, which is in the developing nip N and upstream with respect to a back surface exposure position A (described later). Incidentally, the potential of the charged photosensitive body 1 brushed with the magnetic brush is substantially equal to the applied voltage or less.

Next, the back surface of the photosensitive body 1 is exposed to light. A light source (exposure means) 3 having an LED array 31 illuminate the predetermined position (back surface exposure position) in the developing nip N formed by developer between the developer sleeve 22 and the photosensitive body 1. Thus, a latent image is formed on the exposed photosensitive body 1. The latent image is developed in a development region $N_D$, which is downstream with respect to the back surface exposure position A, in the developing nip N. When conductive toner is used, the electric charge electrostatically induced by the latent image formed on the photosensitive body 1 is applied via a triboelectric brush to the toner at the tip of the triboelectric brush. The latent image is developed with toner separated from the triboelectric brush by Coulomb force acting between the electric charge and the electric charge of the latent image.

Otherwise, when two-component developer consisting of magnetic conductive carriers C and insulating toner T is used in the same apparatus, the triboelectric brush of the conductive carriers serves, as neighboring electrodes. Accordingly, sufficient electrical field for development can be obtained even if the voltage applied between the photosensitive body 1 and the developer sleeve 22 is small. Thus, development with insulating toner can be carried out by applying low voltage.

Since it is difficult to transfer the toner image formed on the photosensitive body 1 onto the transfer medium P in the electric field obtained when conductive toner is employed, development with two-component developer including insulating toner is generally preferred.

OPC photosensitive bodies of the functionally separated type, which are recently most widely used as photosensitive bodies, are hard to apply with electric charge. So, they have not been generally used in the image forming apparatus as described above. But, it has been proved that by forming an electric charge supply layer on the surface, the electric charge supply characteristic of the OPC photosensitive bodies can be improved to realize sufficient electrification. There is another problem concerning the simplified process according to the prior art; fogging in non-image portions. The simplified process comprising steps as described above can not realize "reverse contrast" which is generally employed in the electrophotographic process. Accordingly, fogging easily occurs in non-image portions.

For example, an image was formed with the apparatus shown in FIG. 2: volume resistivity of the conductive particles employed, $10^3$ Ω·cm; an a-Si photosensitive body coated with a silicon calcium carbide; voltage applied to the developer sleeve, +60 V. The photosensitive body was charged with voltage $V_D$ of +55 V, while exposed portions thereof were charged with voltage $V_L$ of +20 V. The photosensitive body charged with such voltages was subjected to development in the development region $N_D$ downstream in the developing nip N. That is, positive toner was reversed to develop the latent image with a design of potentials shown in FIG. 3: non-image forming portions, $V_D$=+55 V; image forming portions (exposed portions), $V_L$=+20 V; and developing potential applied $V_{DC}$=+60 V.

As is clearly seen from the potential design, a development contrast of 50 V was obtained, while no reverse contrast exsisted. The potential $V_D$ of the non-image forming portions was 5 V lower than the developing potential $V_{DC}$, wherein the non-image portions might be developed. Actually, the magnet inside the developer sleeve inhibits the magnetic toner from developing the non-image forming portions. Nevertheless, fogging may easily occur in the above-mentioned simplified process.

As described above, though the simplified process can be carried out with a simple apparatus, images of good quality can not be reliably obtained because of fogging.

SUMMARY OF THE INVENTION

The present invention was made to solve the above-mentioned problems in the prior art, and has an object to provide conditions under which fogging of the images can be reduced.

In order to achieve the above object, the electrophotographic apparatus according to the present invention, which performs image exposure and development at the same time, comprises: an electrophotographic photosensitive body comprising a conductive layer and an electrophotographic photosensitive layer formed on a translucent substrate; optical means for exposing a latent image on the photosensitive body to light by irradiating the translucent substrate with light; and developer means facing the photosensitive layer of the photosensitive body at the exposure position, including a magnetic brush that comes into contact with the photosensitive body to apply developer charged with developing bias, wherein the surface energy of the layers laminated on the photosensitive body is adjusted to be 30 dyne/cm or less and 5 dyne/cm or more; preferably 30 dyne/cm or less and 10 dyne/cm or more.

DETAILED DESCRIPTION OF THE PREFERRED EMBODIMENTS

<Embodiment 1>

Figure 1:
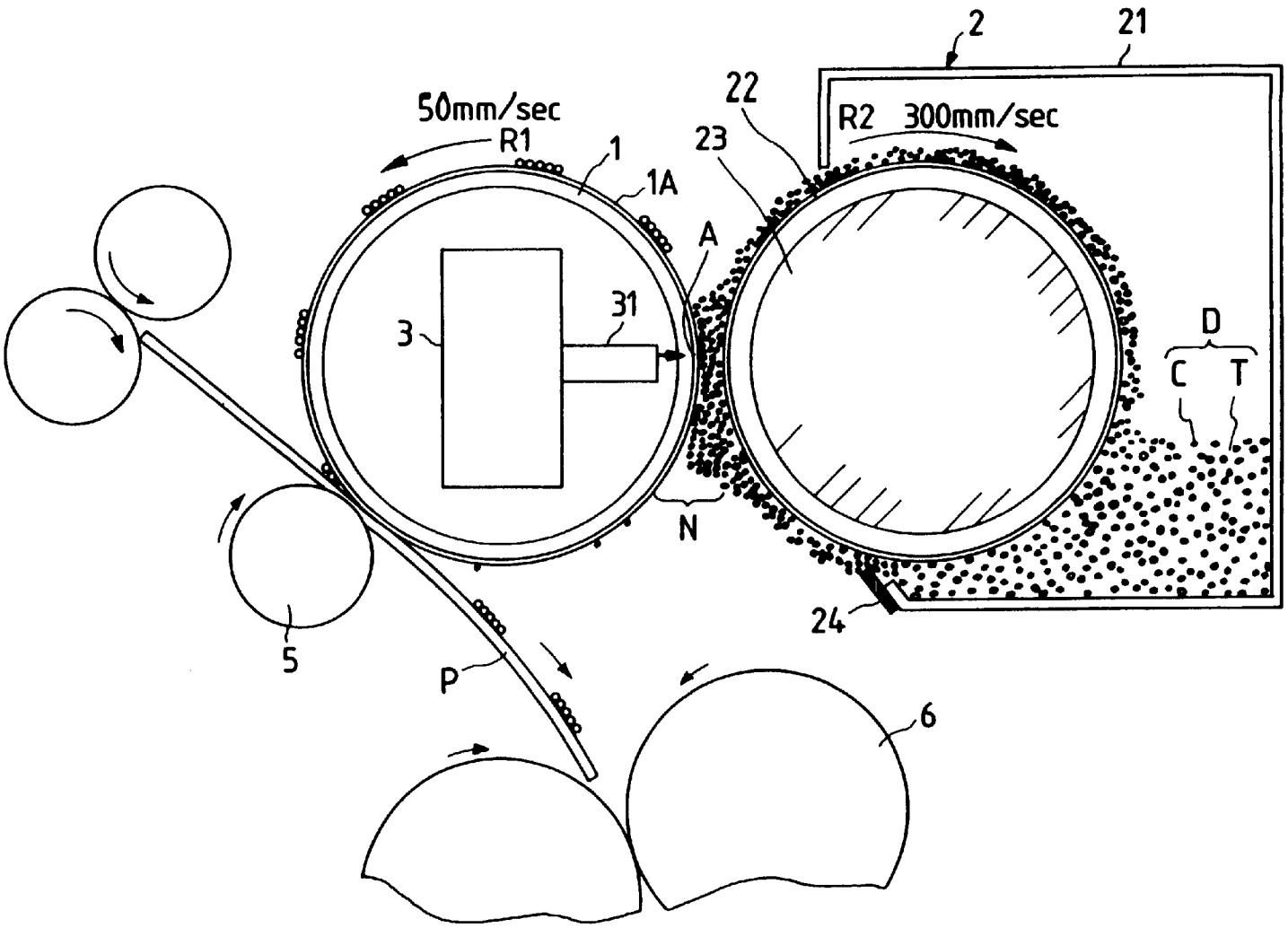
FIG. 1 is a schematic cross-sectional view showing the developer unit of embodiment 1 of the image forming apparatus according to the present invention.
Figure 2:
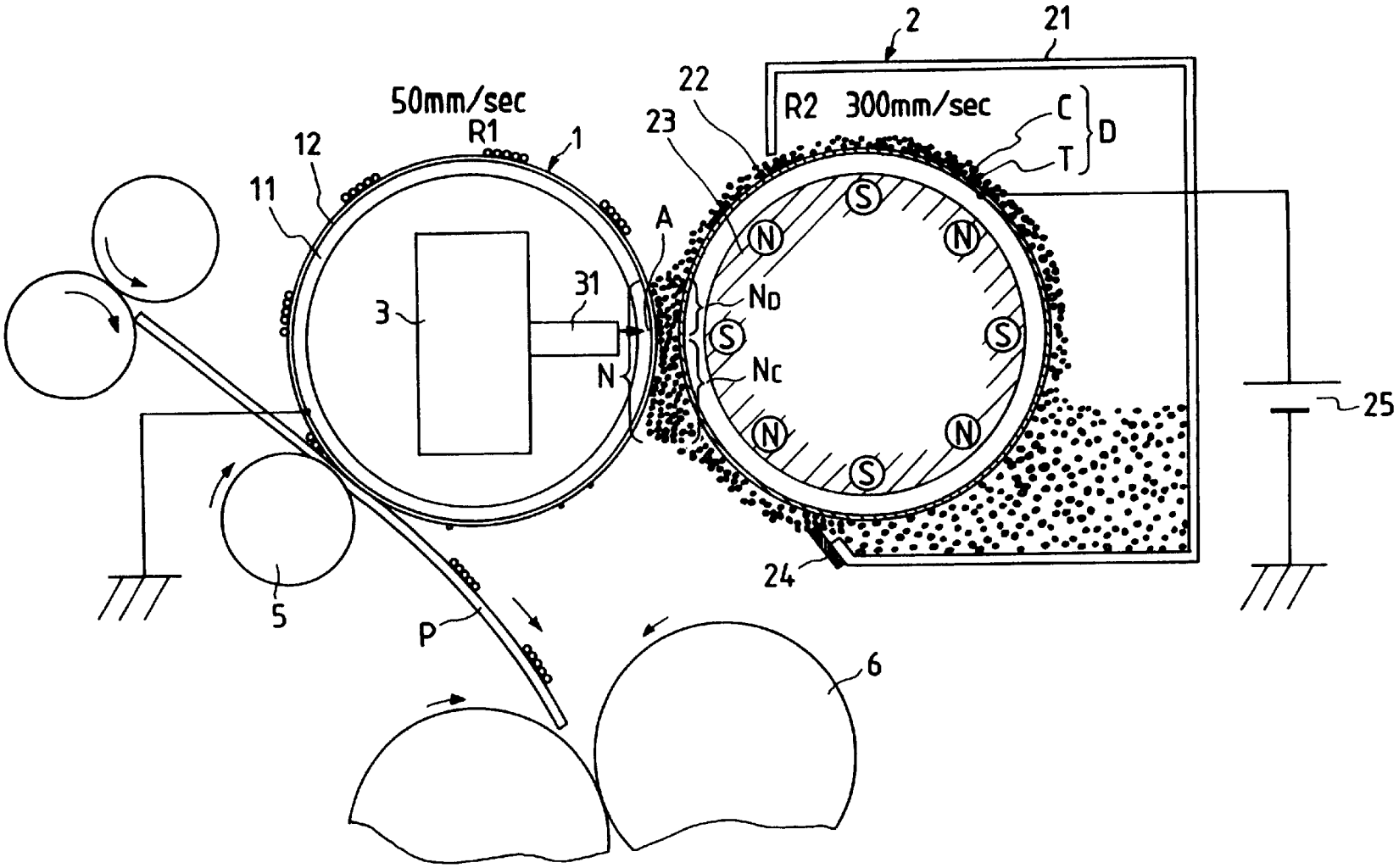
FIG. 2 is a schematic cross-sectional view showing the development unit of a conventional image forming apparatus.
Figure 3B:
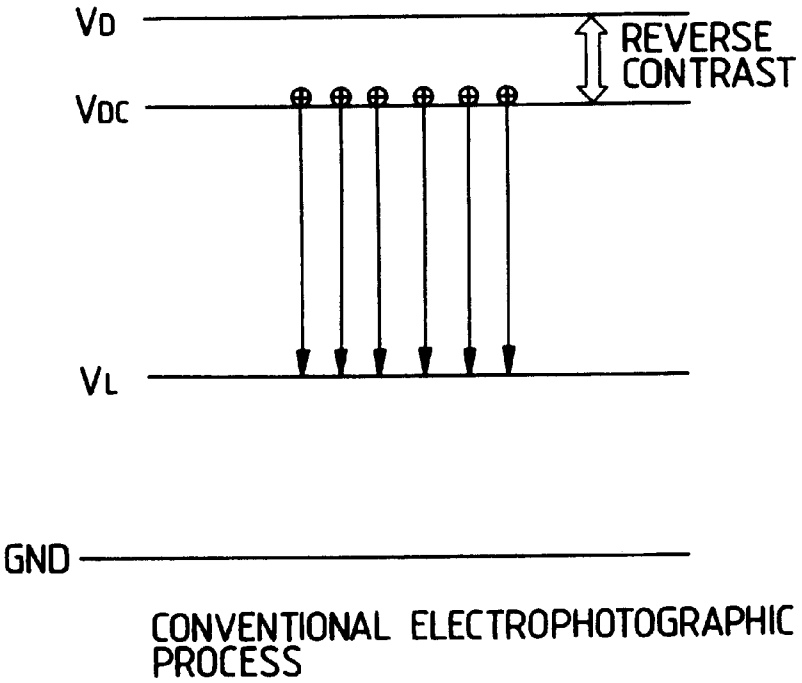
FIG. 3 is a graph showing designs of potentials in the developing position employed in image forming processes in prior art.
Figure 3A:
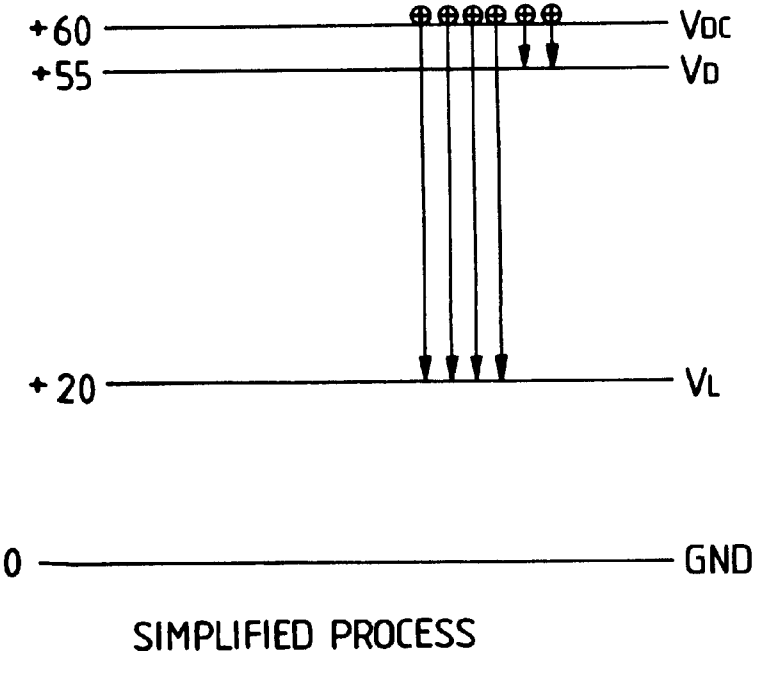

In this embodiment, exposure of the back surface of the photosensitive body, cleaning, electrification and development are simultaneously performed in the image forming process (simplified process) by using the apparatus shown in FIG. 1, wherein a positively chargeable amorphous silicon drum (a-Si drum) is employed as the photosensitive body. Note that portions and components having the same functions as those in FIG. 2 are denoted by the same referential numerals or symbols.

First, the image forming apparatus used in this embodiment will be briefly described with reference to FIG. 1.

A photosensitive body (hereinafter referred to also as "photosensitive drum") 1 is a transparent glass cylinder of a diameter of 30 mm around which photosensitive layers are laminated. The cylinder is made of heat resistance glass, on which an ITO layer serving as a transparent conductive layer is spread with a thickness of about 1 μm. Functional layers are laminated thereon.

On the substrate, there are deposited: an amorphous silicon calcium carbide layer serving as a negative electric charge supply inhibiting layer; an amorphous silicon photosensitive layer; and an amorphous silicon calcium carbide protection layer, in that order. Thus, the photosensitive body is prepared. The amorphous silicon calcium carbide protective layer is generally employed for a-Si photosensitive bodies. In this embodiment, in order to obtain photosensitive surfaces of different surface energy levels, three kinds of samples were prepared which have different degrees of amorphousness and different atomic compositions (the rates of Si to Si+C). The greater the degree of amorphousness, the more stable the material becomes and the smaller its surface energy becomes.

The values of the surface energy (surface tension) of thus prepared photosensitive bodies were measured: Sample 1, 33 dyne/cm; Sample 2, 30 dyne/cm; Sample 3, 28 dyne/cm.

Also a selenium photosensitive body was prepared as a comparative sample, Sample 4, which showed surface energy of 35 dyne/cm when measured in the same way as the above samples.

Note that the values of surface energy here are substituted for by those of surface tension, wherein they were determined, according to the "wet test method for polyethylene- and polypropylene film" prescribed in JIS K 6768-1971, by spreading wet test standard solutions having different wet indexes over the samples.

Now, a developer device 2 will be described. The developer device 2 has a developer container 21 for containing developer D, a rotary developer sleeve 22 of a diameter of 30 mm and a fixed magnet 23 arranged inside the developer sleeve 22. The photosensitive drum 1 is rotated as indicated by the arrow R1, while the developer sleeve 22 is rotated as indicated by the arrow R2 at a circumferential speed six times as large as that of the photosensitive drum 1. Accordingly, the surface of the photosensitive drum 1 and that of the developer sleeve 22 are, while facing each other with a developing nip N therebetween, moving in the same direction.

In this embodiment, as the process speed (the circumferential speed of the photosensitive drum 1) is designed to be 50 mm/sec., the circumferential speed of the developer sleeve 22 is 300 cm/sec. The fixed magnet 23 has eight poles at regular intervals around the axis of the developer sleeve 22, wherein the peak position of each magnet is arranged to be on a line drawn from the center of the photosensitive drum 1 to the center of the developer sleeve 22. The value of magnetic induction at the peak position on the surface of the developer sleeve 22 is designed to be 800 gauss.

The developer D is a mixture of two components; magnetic conductive carriers C (hereinafter also referred to as simply "carriers") and magnetic insulating toner T (also referred to as simply "toner"). The magnetic conductive carriers C contribute to cleaning of the residual toner which was not transferred, electrification of the surface of the photosensitive drum 1 and transmission of the toner. The grain diameter of the carriers is 25 $\mu$m and the value of volume resistivity is $10^3$ Ω·cm. The carriers are resin carriers prepared by dispersing magnetite and, for the sake of increasing conductivity, carbon black in polyethylene resin. The magnetic insulating toner T is a negative toner, whose grain diameter is 7 $\mu$m and whose volume resistivity is $10^{14}$ Ω·cm.

The toner T and the carriers C are mixed at a T/D rate of 15% (the weight percentage of the toner T in the total weight of the developer D). The mixture is contained in the developer container 21, in which the developer sleeve 22 faces a metal blade 24 for regulating the thickness of the toner with which the surface of the developer sleeve 22 is coated so that the thickness of the toner layer becomes about 1 mm. The clearance between the developer sleeve 22 and the photosensitive drum 1 is determined to be 0.5 mm by means of contact rollers (not shown) provided at the end portions of the developer sleeve 22 and the photosensitive drum. In this way, the developing nip N between the photosensitive drum 1 and the developer sleeve 22 which are rotated at respective predetermined speeds is determined to be 7 mm.

Voltage of +60 V is applied to the developer sleeve 22 and through it to the photosensitive drum 1 to perform reverse development with negative toner.

An exposure means 3 having an LED array 31 is contained in the photosensitive drum 1 to illuminate the back surface exposure position A in the developing nip N, which is 2 mm upstream from the downstream edge of the developing nip N. If the back surface exposure position A is arranged too far upstream, then the latent image formed by exposure is charged again by the conductive carriers and the contrast of the latent image decreases. In this case the density of the resultant image can not be increased. On the other hand, if the back surface exposure position A is arranged too far downstream, the development must be carried out in too small an area, which also reduces the image density.

The toner image developed as described above is transferred onto a transfer medium P by a transfer roller 5. The transfer roller 5 used in this embodiment has a resistance of $5\times10^7$ Ω and is applied with voltage of +500 V. The toner which is not transferred in the transfer position will be scraped off upstream in the developing nip N during the next image forming operation, and will not damage the image forming process.

An example of an image forming process using the above-mentioned apparatus will be described.

Upstream in the developing nip N formed by the photosensitive drum 1 and the developer sleeve 22, the residual toner on the photosensitive drum 1 used in the previous image forming operation is scraped off by the magnetic brush which is rotated at high speed. At the same time, the conductive carriers come into contact with the photosensitive drum 1 to supply electric charge to the conductive particles in the electric charge supply layer 1A of the photosensitive drum 1. Thus the photosensitive drum 1 is charged with electricity. In this embodiment, when voltage of +60 V was applied to the developer sleeve 22, the photosensitive drum 1 gets a potential of +55 V. The back surface of the photosensitive drum 1 is subjected to LED exposure at the back surface exposure position A to reduce the potential of the exposed portions (bright portions) to +5 V. After exposure, contact development in the electric field is carried out in the developing nip N.

Samples 1 to 3 of the a-Si photosensitive drums used in this embodiment, when applied with a developing potential of +60 V, all showed a shielded portion potential of +55 V and an exposed portion potential of +5 V, that is a development contrast of 50 V. But even the potential of the non-image forming portions is 5 V lower than the developing potential. In other words, as reverse contrast can not be obtained as in the ordinary electrophotography process, the electric field may even held the toner develop the non-image forming portions and generate fogging.

In the simplified process, though the value of the potential for development is as small as several tens of volts, the developing electric field acting on the toner is strong enough to increase the image density. The tip of the triboelectric brush of the conductive carriers is very close to the photosensitive drum 1. Each a-Si photosensitive drum used in this embodiment provided an image having a density of about 1.3, which was measured with a Macbeth's reflection density meter. On the contrary, the measured amount of fogging in the non-image-forming portions obtained by using respective a-Si photosensitive drums were different, as shown in Table 1.

The amount of fogging was defined as the difference between the reflection power of the printed transfer medium and that of non-printed one measured with a photovoltmeter. Also, experiment was made in which the amount of fogging generated by respective a-Si photosensitive drum samples and the above-mentioned selenium photosensitive drum sample as measured while voltage applied to the developer sleeve 22 was changed (see FIG. 4).

TABLE 1

| | Surface energy | Reflection density of fogging |
|---|---|---|
| Sample 1 | 33 dyne/cm | 4.5% |
| Sample 2 | 30 dyne/cm | 4.0% |
| Sample 3 | 28 dyne/cm | 3.8% |
| Sample 4 | 35 dyne/cm | 4.8% |

Figure 4:
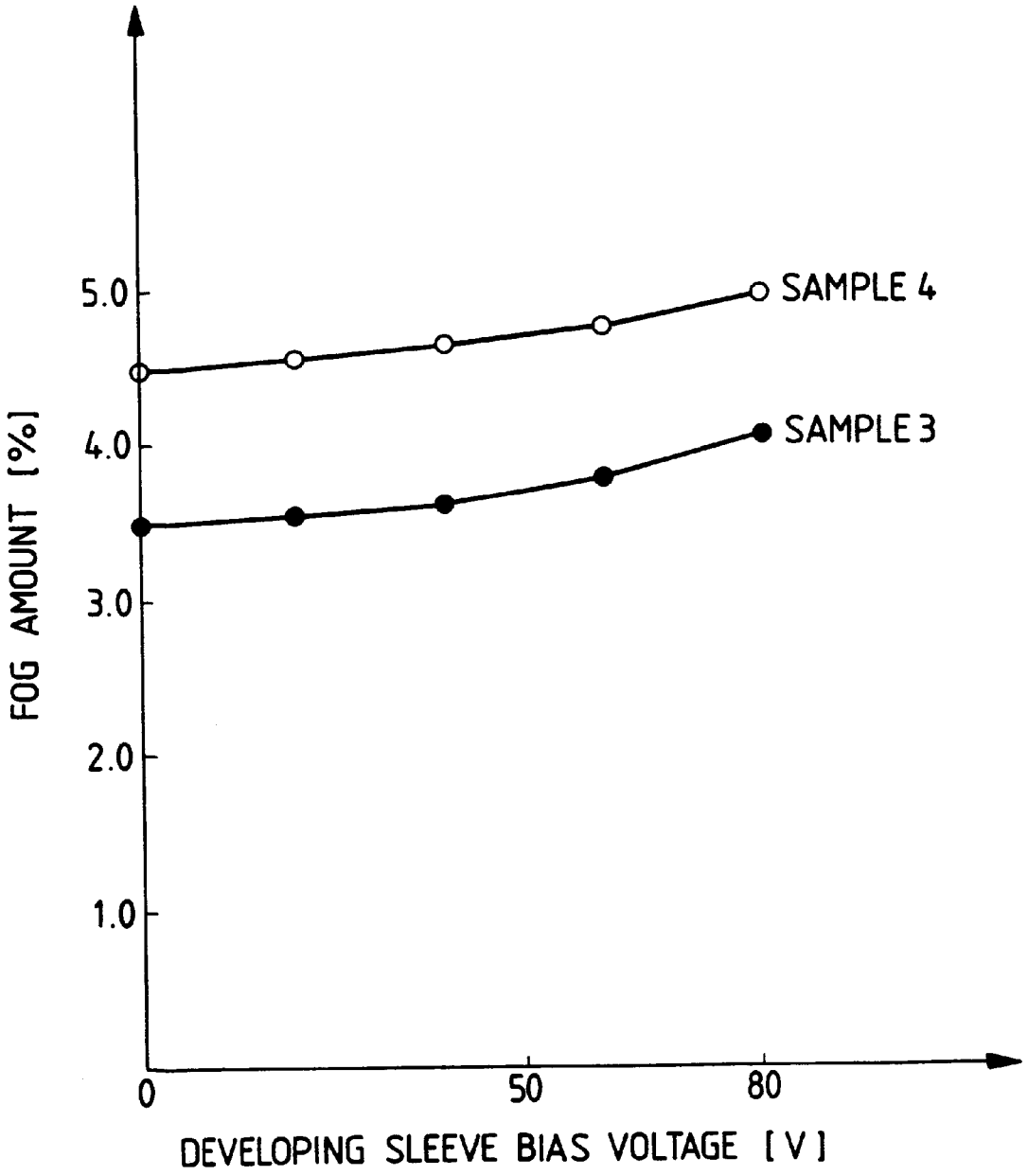
FIG. 4 is a graph showing the relation between the voltage applied to the developer sleeve and the amount of fogging.

As understood from Table 1 and FIG. 4, it is surface energy rather than the voltage applied to the developer sleeve that predominantly determines the amount of fogging in the non-image forming portions.

The reason is that fogging is mainly caused by van der Waals force between the toner and the photosensitive drum surface in the apparatus used in this embodiment in which the attraction of the non-image forming portions generated by the potential difference between the non-image forming portions and the charged developer sleeve 22 is substantially canceled by the magnetic force of the fixed magnet 23 constraining the toner.

A visually inspected panel test was made, which showed that 4.0% or less of fogging in the non-image forming portions is tolerable in practice. Therefore, by reducing the surface energy of the photosensitive drum to 30 dyne/cm (as Sample 2) or less, fogging can be suppressed under the level where fogging does not matter in practice.

<Embodiment 2>

In this embodiment, a negatively chargeable organic photo-semiconductor of the functionally separated type is employed as the photosensitive drum. The photosensitive drum is further provided with an electric charge supply layer having small surface energy as a surface layer. The electric charge supply layer prepared by dispersing conductive particles in an insulating resin acts as a condenser, wherein the photosensitive layer serves as dielectric substance and conductive particles as micro float electrodes. Electric charge is supplied through a magnetic conductive brush.

With such an electric charge supply layer, even a photosensitive body such as OPC, which can not be used in the conventional simplified process because the photosensitive layer surface has no levels to trap electric charge, can be sufficiently charged. Accordingly, materials used for the photosensitive body can be selected more freely.

The electric charge supply layer formed on the photosensitive drum enables the surface of the photosensitive drum to be charged in an instant even with a magnetic brush having a value of resistance as high as $10^6$ Ω. In addition, when the electric charge supply layer is applied to an OPC photosensitive drum and the like having a high withstand voltage, the conductive magnetic brush can be charged with several hundred volts, while conventional a-Si photosensitive drums having a low withstand voltage can be charged only with a voltage of several tens of volts. Accordingly, sufficient image density can be obtained by making a large potential difference used for development.

The same apparatus used in the above-mentioned Embodiment 1 is also used in this embodiment except for the photosensitive drum. Incidentally, as a negatively chargeable photosensitive drum is used in this embodiment instead of the positively chargeable photosensitive drum used in embodiment 1, the development performed here is the reverse or reflection development with negative toner.

The a-Si photosensitive drum is replaced by the ordinary OPC photosensitive body coated with an electric charge supply layer, which is prepared by dispersing 120 wt % of titanium dioxide in polycarbonate serving as binder.

With excessive conductive fillers dispersed in the electric charge supply layer, the surface electrical resistance of the photosensitive drum is reduced especially in a high temperature/high humidity environment, and the image may be disturbed. On the other hand, with insufficient conductive fillers, the chargeable portion on the entire surface of the photosensitive drum is reduced, which may cause insufficient electrification. Therefore, it is preferable to disperse 5 to 250 wt % of titanium dioxide, which includes the case of this embodiment; 120 wt %.

In this embodiment, fluorine-contained resin particles are also dispersed in the binder in order to reduce the surface energy of the photosensitive drum. PTFE particles manufactured by DuPont Co. were used. The particle diameter is about 0.5 μm. As the surface energy of PTFE resin is as small as 21.5 dyne/cm, the dispersed PTFE particles can remarkably reduce the surface energy of the photosensitive drum. Sample 5 with 5 wt % of PTFE particles dispersed in the binder, Sample 6 with 10 wt % of PTFE particles and Sample 7 without PTFE particles were compared.

According to the conventional electrophotographic process, such a large amount of particles as mentioned above can not be dispersed on the surface of the photosensitive drum, because they make it impossible to sufficiently expose the latent image on the photosensitive drum to light. According to the simplified process employed in this embodiment, however, the back surface of the photosensitive drum is illuminated to expose the latent image.

Accordingly, since the outer surface of the photosensitive drum does not have to be translucent, a lot of particles can be dispersed therein, as in this embodiment.

TABLE 2

| | Amount of added PTFE | Surface energy | Amount of fogging |
|---|---|---|---|
| Sample 5 | 5% | 32 dyne/cm | 4.3% |
| Sample 6 | 10% | 30 dyne/cm | 4.0% |
| Sample 7 | 0% | 34 dyne/cm | 4.6% |

The results shown in Table 2 illustrate that the smaller the surface energy of the photosensitive drum, the less fogging is generated in the non-image forming portions. In order to realize 4.0% of or less of fogging, which is tolerable in practice, 10 wt % or more teflon should be dispersed to reduce surface energy to 30 dyne/cm or less. The result coincides well with the result of the experiment made in Embodiment 1, which proves the correlation between the amount of fogging and surface energy.

Though, in this embodiment, the particles having small surface energy are dispersed in the binder, the binder itself may be made of material having small surface energy. As described before, the electric charge supply layer on the photosensitive drum surface does not have to be translucent, so various kinds of materials can be used for the binder.

For example, an electric charge supply layer may be prepared by dispersing ZELEC ECP (particles whose diameter is about 1 to 10 μm, coated with silica, and further with PTFE in which stannic oxide is doped to reduce resistance) manufactured by DuPont Co. as conductive fillers in the binder of PFA. By using thus prepared electric charge supply layer, the entire surface layers of the photosensitive drum can be made of fluorine-containing resins to remarkably reduce surface energy.

<Embodiment 3>

In this Embodiment, in order to reduce the surface energy of the photosensitive drum, the thickness of the photosensitive layer is reduced to be several Å to reduce resistance so that the residual potential may be sufficiently small. As the coating material a diamond-like thin film is employed.

In this embodiment, conductive particles are dispersed in binder having a small surface energy in order to obtain both small surface energy of the surface of the photosensitive drum and a good electrification characteristic of the photosensitive drum, wherein the rate of dispersed conductive particles is as high as several tens wt %. Thus, the conductive particles are exposed outward in large part of the entire photosensitive drum surface. As a result, a binder having a small surface energy may not always be made good use of. If the surface is finally coated with the binder, then such a problem is solved. In this case, however, we must give up good electrification characteristic. Moreover, even if the photosensitive drum is charged well, then the residual potential after exposure also becomes higher.

Therefore, in this embodiment, the surface of the photosensitive drum is coated with a thin film of material having a small surface energy so that the electric charge can be transmitted by the tunnel effect. Thus, a good electrification characteristic and low residual potential after exposure can be obtained at the same time. In an attempt to realize the tunnel effect and transmit electric charge effectively, the thickness of the film must be several angstroms. So, in this embodiment, carbon is deposited to form a diamond-like thin film.

More specifically, on an ordinary OPC photosensitive drum, the same electric charge supply layer as in Embodiment 2, 120 wt % of titanium dioxide dispersed in the polycarbonate binder, was laminated. Thereon, the diamond-like thin film was formed.

An experiment was made to compare Sample 8; a photosensitive body coated only with the electric charge supply layer, with Sample 9; a photosensitive body according to the present embodiment, which is further coated with the diamond-like thin film. When images were obtained using the apparatus shown in FIG. 1, the image developed by using Sample 8 showed 4.8% of fogging. But, by using Sample 9, the amount of fogging could be reduced to 3.6%.

Incidentally, the minimum value of the surface energy is determined by conditions required to hold the toner on the photosensitive body after development. In general, the minimum value is 5 dyne/cm or more, preferably 10 dyne/cm or more.

As described above, by coating the photosensitive drum surface with the thin film of material having small surface energy, a good electrification characteristic, low residual potential and reduction of fogging in the image can be realized at the same time.

According to the present invention, by designing the surface energy of the photosensitive body to be within a range of 5 to 30 dyne/cm, more preferably within a range of 10 to 30 dyne/cm, the amount of fogging in the non-image forming portions can be minimized. Especially, when the electric charge supply layer is formed, various kinds of materials can be employed as the binder of the electric charge supply layer. Also various conductive fillers can be used. Accordingly it is easier to improve the electrification characteristic of the photosensitive body and reduce the surface energy thereof, because the photosensitive body can be designed more freely.

What is claimed is:

1. A charging system for an electrophotographic photosensitive member, comprising:

a rotatable electrophotographic photosensitive member including a conductive substrate and an electrophotographic photosensitive layer disposed thereon, a surface energy of a surface layer at a side of the photosensitive layer being equal to or less than 30 dyne/cm; and a rotatable conductive brush rotating at a speed faster than that of said photosensitive member and formed by conductive magnetic particles, and to which a bias voltage is applied for charging said photosensitive member, by scrubbing the surface layer of said photosensitive member.

2. A charging system according to claim 1, wherein the photosensitive layer includes an organic optical conductive substance and is formed by dispersing a fluoride resin and conductive particles into a binder resin.

3. A charging system according to claim 1, wherein the photosensitive layer includes an amorphous silicon.

4. A charging system for an electrophotographic photosensitive member, comprising:

a rotatable electrophotographic photosensitive member including a conductive substrate and an OPC photosensitive layer disposed thereon, a surface layer of the OPC photosensitive layer being formed by dispersing a fluoride resin and conductive particles into a binder, and a surface energy of the surface layer at a side of the photosensitive layer being equal to or less than 30 dyne/cm; and a rotatable conductive brush rotating at a speed faster than that of said photosensitive member and formed by conductive magnetic particles, and to which a bias voltage for charging said photosensitive member is applied by scrubbing the surface layer of said photosensitive member.

5. A charging system according to claim 4, wherein the surface energy is equal to or more than 5 dyne/cm.

6. A charging system according to claim 5, wherein the fluoride resin is dispersed into the binder in a ratio equal to or more than 10 wt %.

7. A charging system according to claim 4, wherein the fluoride resin has a particle diameter of about 0.5 $\mu$m.

8. A charging system according to claim 4, wherein said conductive brush is magnetized.

9. An electrophotographic apparatus, comprising:

a rotatable electrophotographic photosensitive member including a conductive substrate and an electrophotographic photosensitive layer disposed thereon, a surface energy of a surface layer at a side of the photosensitive layer being equal to or less than 30 dyne/cm;

a conductive brush rotating at a speed faster than that of said photosensitive member and formed by conductive magnetic particles, and to which a bias voltage for charging said photosensitive member is applied, for scrubbing the surface layer thereof;

optical means for irradiating optical information onto said photosensitive member after charging by said conductive brush; and toner applying means for applying a toner to said photosensitive member from a side of said conductive brush for developing an image corresponding to the optical information.

10. An electrophotographic apparatus according to claim 9, wherein said electrophotographic photosensitive member includes a conductive substrate and an OPC photosensitive layer disposed thereon, a surface layer of the OPC photosensitive layer being formed by dispersing a fluoride resin and conductive particles into a binder.

11. An electrophotographic apparatus according to claim 10, wherein the fluoride resin is dispersed into the binder in a ratio equal to or more than 10 wt %.

12. An electrophotographic apparatus according to claim 10, wherein the fluoride resin has a particle diameter of about 0.5 $\mu$m.

13. An electrophotographic apparatus according to claim 9, wherein the surface energy is equal to or more than 5 dyne/cm.

14. An electrophotographic apparatus according to claim 9, wherein said conductive brush is magnetized.

* * * * *

UNITED STATES PATENT AND TRADEMARK OFFICE

CERTIFICATE OF CORRECTION

PATENT NO. : 5,963,762

DATED : October 5, 1999

INVENTOR(S) : Tadashi FURUYA, et al.

It is certified that error appears in the above-identified patent and that said Letters Patent is hereby corrected as shown below:

COLUMN 1:

Line 27, "This-image" should read --This image--.
Line 28, "carriers" should read --carries--.

COLUMN 2:

Line 31, "illuminate" should read --illuminates--.
Line 49, "serves," should read --serves--.

COLUMN 3:

Line 33, "can not" should read --cannot--.

COLUMN 4:

Line 18, "of" should read --having--.

COLUMN 5:

Line 45, "can not" should read --cannot--.

COLUMN 6:

Line 16, "can not" should read --cannot--.
Line 18, "held" should read --help--.
Line 28, "non-image-forming" should read --non-image forming--.

UNITED STATES PATENT AND TRADEMARK OFFICE

CERTIFICATE OF CORRECTION

PATENT NO. : 5,963,762

DATED : October 5, 1999

INVENTOR(S) : Tadashi FURUYA, et al.

It is certified that error appears in the above-identified patent and that said Letters Patent is hereby corrected as shown below:

COLUMN 7:

Line 12, "can not" should read --cannot--.
Line 67, close up right margin.

COLUMN 8:

Line 1, close up left margin.
Line 15, "of" (first occurrence) should be deleted.

Signed and Sealed this

Thirtieth Day of January, 2001

*Attest:*

Q. TODD DICKINSON

*Attesting Officer*

*Director of Patents and Trademarks*